US007476773B2

(12) United States Patent
Louret et al.

(10) Patent No.: US 7,476,773 B2
(45) Date of Patent: Jan. 13, 2009

(54) PROCESS FOR PREPARING A GAS OIL BY OLIGOMERIZATION

(75) Inventors: Sylvain Louret, Lyons (FR); Vincent Coupard, Vaulx En Velin (FR); Laurent Simon, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 178 days.

(21) Appl. No.: 11/476,203

(22) Filed: Jun. 28, 2006

(65) Prior Publication Data

US 2007/0015945 A1 Jan. 18, 2007

(30) Foreign Application Priority Data

Jun. 28, 2005 (FR) ..... 05 06589

(51) Int. Cl.
*C07C 2/00* (2006.01)

(52) U.S. Cl. ..... 585/329; 585/301; 585/311; 585/312; 585/314; 585/315; 585/326; 585/510; 585/531; 568/38

(58) Field of Classification Search ..... 585/301, 585/311, 312, 314, 315, 531, 329, 510, 326; 568/38

See application file for complete search history.

(56) References Cited

U.S. PATENT DOCUMENTS 4,487,985 A 12/1984 Tabak
4,497,968 A * 2/1985 Wright et al. ..... 585/304
4,855,524 A 8/1989 Harandi et al.
4,897,245 A 1/1990 Hsia et al.
5,043,499 A * 8/1991 Harandi et al. ..... 585/301
6,025,533 A 2/2000 Vora et al.
6,846,965 B1 1/2005 Schulz et al.
2004/0181105 A1 9/2004 Heidemann et al.
2004/0204614 A1 * 10/2004 Groten et al. ..... 568/38

FOREIGN PATENT DOCUMENTS

WO WO 00/69795 * 11/2000

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

A process for preparing a gas oil cut comprises the following steps in succession:

1) oligomerizing an olefinic C2-C12 hydrocarbon cut, preferably $C_3$-$C_7$ and more preferably $C_3$-$C_5$;
2) separating the mixture of products obtained in step 1) into three cuts: a light cut containing unreacted C4 and/or C5 olefinic hydrocarbons, an intermediate cut having a T95 in the range 200-220° C. and a heavy cut comprising the complement; T95 being the temperature at which 95% by weight of product has evaporated, as determined in accordance with standard method ASTM D2887;
3) oligomerizing the intermediate cut obtained in the separation step;

characterized in that in step 3), oligomerization is carried out in the presence of an olefinic C4 and/or C5 hydrocarbon cut in a weight ratio of intermediate cut to olefinic $C_4$ and/or $C_5$ cut in the range of 60/40 to 80/20.

23 Claims, 2 Drawing Sheets

PROCESS FOR PREPARING A GAS OIL BY OLIGOMERIZATION

FIELD OF THE INVENTION

The invention relates to a process for producing a gas oil cut by oligomerizing olefinic hydrocarbon cuts.

More particularly, the invention relates to a process for preparing a gas oil cut comprising two oligomerization steps between which a separation step is interposed.

Demand for "gas oil" type fuel is constantly rising and the ratio of gas oil to gasoline is constantly being displaced in favour of gas oil, particularly in France and in the majority of European countries.

Gas oil fuel is usually derived from catalytic hydrogenation of a mixture (also termed the gas oil pool) of principally linear hydrocarbon cuts containing at least 12 carbon atoms deriving from various refining processes.

Gas oil fuel is not only characterized by its chemical composition, but also by its properties, in particular:

the distillation interval;

the cetane index;

the viscosity;

the smoke point;

the density;

the bromine index.

A conventional gas oil fuel must satisfy the following specifications:

a distillation interval of 160° C. to 370° C.;

a cetane index of more than 48;

a viscosity, according to ISO 3104 at 40° C., of 2.2 to 4.5 cSt;

a smoke point of less than −10° C.;

density: 0.8 to 0.85 g/cm$^3$;

a bromine index of less than 13 gBr/100 g.

To improve the properties of a gas oil fuel, it is important to have a cetane index which is as high as possible, a value of 45 being the lower limit, while keeping the smoke point sufficiently low.

Catalytic oligomerization is a process for the addition of olefinic molecules which can increase the number of carbon atoms (or chain length) to place it in the range of molecules constituting a gas cut, i.e. from 1 to about 30 carbon atoms.

Such a process is described, for example, in EP-A-0 536 912 which proposes a two-step catalytic oligomerization process. However, since the selectivity of oligomerization is relatively low, the product obtained has a mediocre cetane index.

U.S. Pat. Nos. 4,855,524 and 4,926,003 describe catalytic oligomerization processes which combine two oligomerization reactions. However, the cetane index obtained is not always satisfactory, and problems with catalyst stability persist, "stability" being understood in the sense of maintaining the activity of the catalyst over time.

Any improvement in the stability of the catalyst could substantially reduce the cost of carrying out such processes.

Thus, there exists a genuine need for a process for producing a gas oil cut which can produce a gas oil cut having, post-hydrogenation, a very high cetane index with a satisfactory yield, while keeping the stability of the catalyst good.

BRIEF DESCRIPTION OF THE INVENTION

Figure 1:
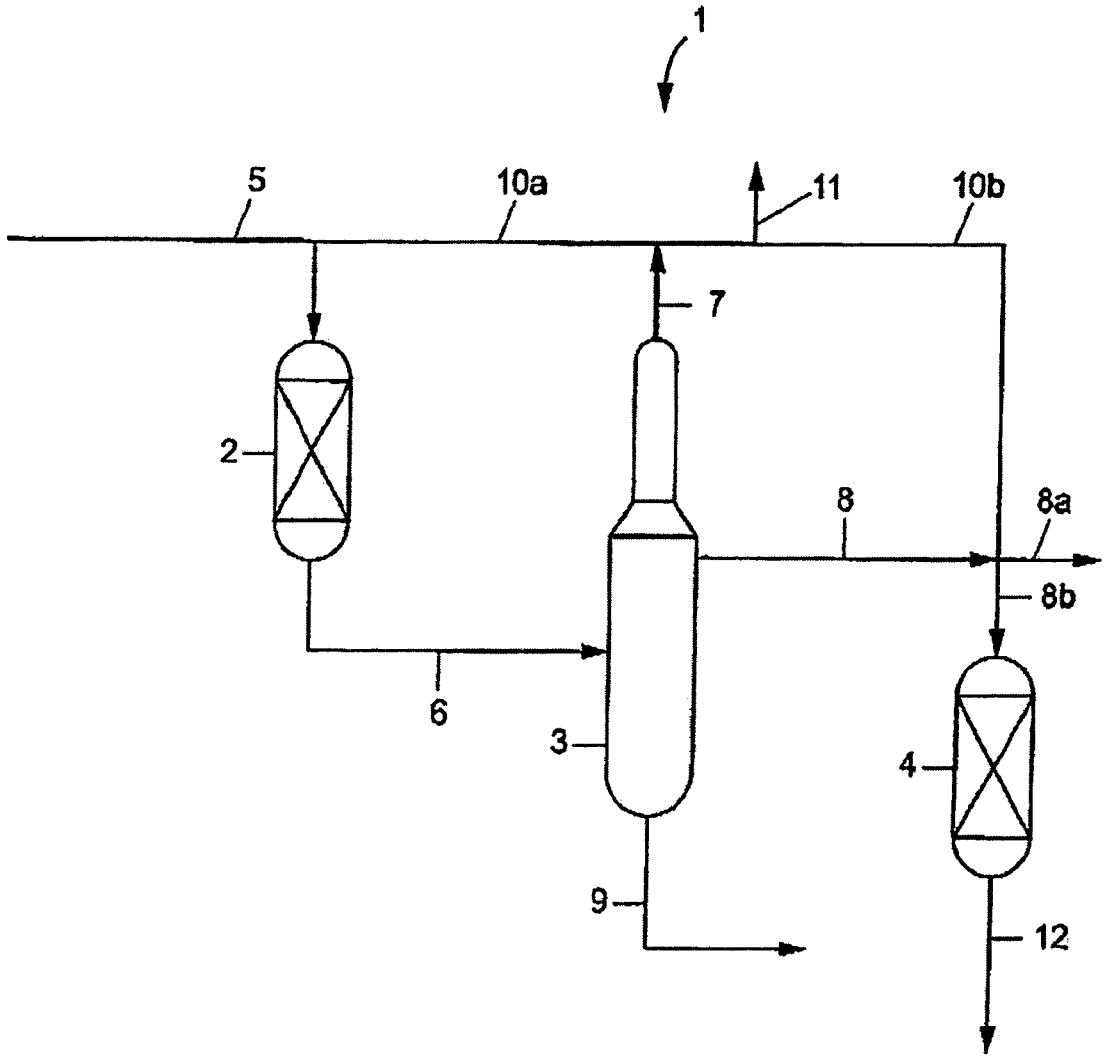
FIG. 1 shows a flowchart for a process in accordance with the invention which distinguishes the first oligomerization step, the separation step and the second oligomerization step.

The present invention describes a process for preparing a gas oil cut, which comprises the following steps in succession:

1) oligomerizing an olefinic $C_2$-$C_{12}$ hydrocarbon cut, preferably $C_3$-$C_7$ and more preferably $C_3$-$C_5$;

2) separating the mixture of products obtained in step 1) into three cuts: a light cut containing unreacted $C_4$ and/or $C_5$ olefinic hydrocarbons with a T95 of less than 100° C., preferably less than 50° C., an intermediate cut having a T95 in the range 180° C. to 240° C., preferably in the range 200-220° C., and a heavy cut corresponding to a T95 of more than 240° C. and preferably more than 220° C.;

T95 being the temperature at which 95% by weight of product has evaporated, as determined in accordance with standard method ASTM D2887;

3) oligomerizing the intermediate cut obtained in the separation step, said intermediate cut being mixed with at least a portion of the light $C_4$-$C_5$ cut from said separation step in proportions such that the ratio between the intermediate cut and the olefinic $C_4$-$C_5$ cut is in the range 60/40 to 80/20 by weight.

DETAILED DESCRIPTION OF THE INVENTION

In the present invention, the term "oligomerization" means polymerization or addition limited essentially to 2 to 6 monomers or base molecules.

Each of the oligomerization reactions of steps 1) and 3) is carried out in the presence of an amorphous acidic catalyst or a zeolitic type catalyst.

In step 1), the catalyst and the reaction conditions are selected so that the reaction is mainly a dimerization reaction, i.e. an oligomerization reaction or an addition reaction limited to two monomers or base molecules.

The reaction is considered to be "mainly" dimerization if at least 50%, preferably at least 65% and still more preferably at least 80% of the products obtained are dimers, the remaining percentages being constituted by unreacted starting products and trimerization or higher oligomerization products.

The catalyst and the oligomerization reaction conditions of step 3) are selected so that the oligomerization is essentially linear and the secondary reactions are limited.

Oligomerization is considered to be "essentially linear" when at least 75%, preferably at least 80% and more preferably at least 90% of the oligomers obtained are linear.

Because a $C_4$ and/or $C_5$ cut is introduced as a mixture with the intermediate cut during the oligomerization reaction of step 3), a wide range of chain lengths is represented in the resulting product mixture. Put simply, if the effluent arriving in step 3) is a $C_8$ hydrocarbon, after oligomerization the mixture obtained will comprise $C_{16}$, $C_{24}$ and $C_{32}$ hydrocarbons, i.e. the number of carbon atoms will be in multiples of 8.

If oligomerization is carried out in accordance with the invention, i.e. by introducing $C_4$ hydrocarbons, in addition to the above hydrocarbons, the final mixture will contain $C_{12}$, $C_{20}$, $C_{28}$ hydrocarbons, i.e. the number of carbon atoms will be in multiples of 4.

The range of hydrocarbons obtained by oligomerization of the invention will thus be broadened.

Advantageously, adding $C_4$ and/or $C_5$ olefinic hydrocarbons is carried out so that the ratio between the intermediate cut obtained in step 2) and the olefinic $C_4$ and/or $C_5$ hydrocarbon cut is preferably in the range 60/40 to 80/20 by weight.

According to a first implementation of the process of the invention, at least a portion, and possibly all of the olefinic $C_4$ and/or $C_5$ hydrocarbon cut introduced during step 3) mixed with the intermediate cut derives from the light cut obtained during the separation step 2).

In a second implementation, the process of the invention further comprises a step 4) for separating the product obtained at the end of step 3) into a light cut, an intermediate cut and a heavy cut, the light, intermediate and heavy cuts being defined in the same manner as that during the separation step 2).

In accordance with a preferred implementation of the process of the invention, the light cut obtained in step 2) and/or step 4) is recycled towards the second oligomerization step 3), either in its entirety if the ratio between the intermediate cut from the separation step 2) and said light $C_4$-$C_5$ cut requires it, or partially, and in this case the excess portion of said light cut is recycled to the inlet to the oligomerization step.

The term "and/or" should be understood to mean that it encompasses the following cases: either the light cut obtained in step 2) alone, or the light cut obtained in step 4) alone, or total or partial addition of the light cuts obtained in steps 2) and 4).

The yield of intermediate cut and heavy cut from the oligomerization reaction is thus substantially enhanced.

The heavy cut from step 2) and optionally the heavy cut from step 4) may be hydrogenated. They are then mixed with gas oil cuts of other origins, to obtain a gas oil type fuel of commercial quality satisfying the required specifications.

Figure 2:
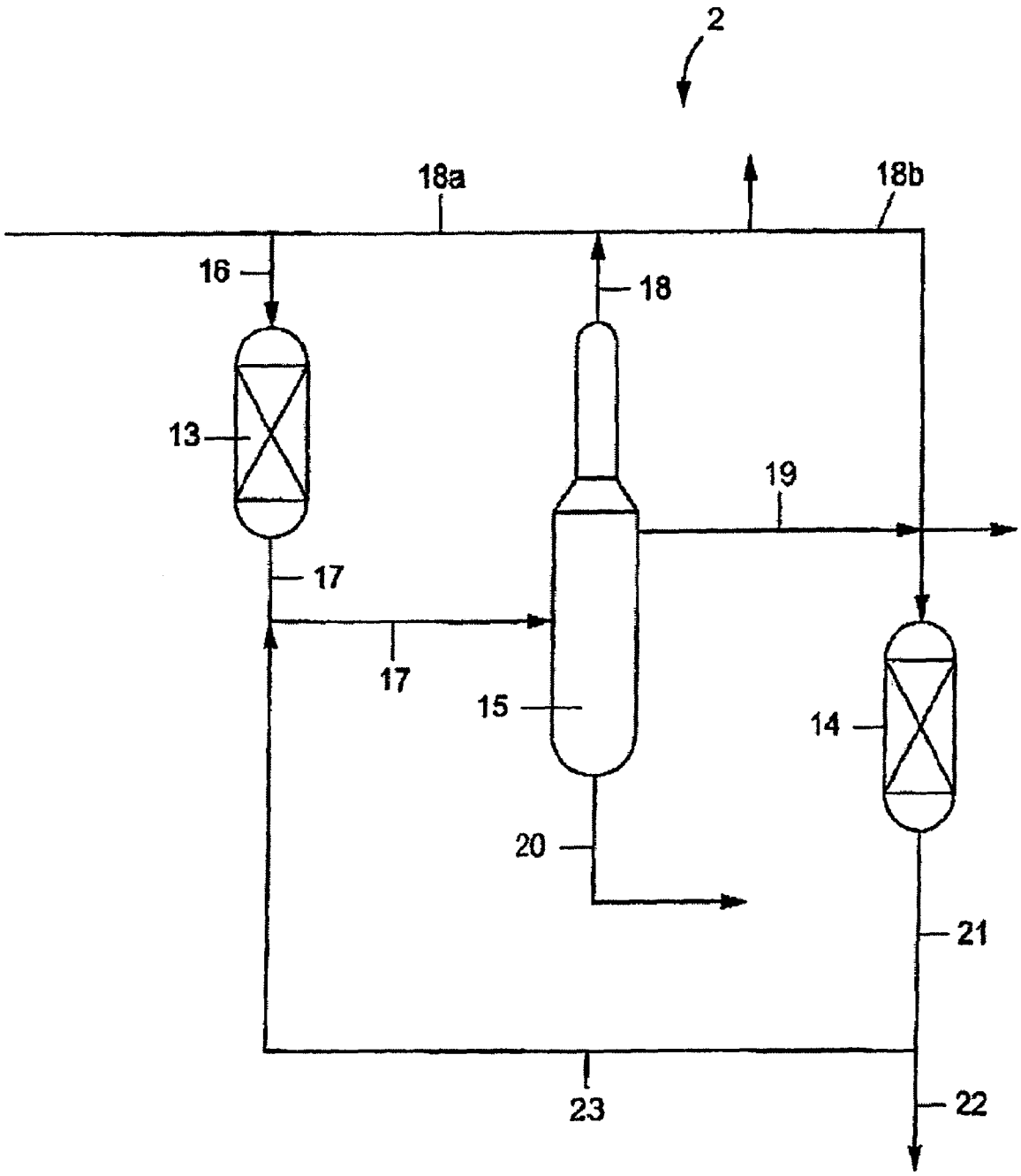
FIG. 2 shows a flowchart for a process of the invention which, in addition to the 3 steps of FIG. 1, distinguishes recycling of the base cut extracted from the second oligomerization step to the separation step.

The operating conditions for each of the steps will now be described in more detail, in particular in connection with the accompanying drawings in which:

FIG. 1 shows a flowchart for a process of the invention in a first implementation;

FIG. 2 shows a flowchart for a process of the invention in a second implementation.

The feed used in oligomerization step 1) is constituted by an olefinic hydrocarbon cut containing 2 to 12 carbon atoms, preferably 3 to 7 carbon atoms, and more preferably 4 to 6 carbon atoms.

This cut contains 20% to 100% by weight, and preferably more than 50% by weight of olefins, linear olefins constituting the majority of the olefins, i.e. preferably more than 50% by weight of all of the olefins.

This feed may undergo pre-treatment intended to reduce the amount of sulphur-containing compounds, nitrogen-containing compounds, dienes, oxygen-containing compounds or branched compounds.

This pre-treatment is carried out by conventional processes, for example washing with water, a treatment over an oxide catalyst, etherification of branched olefins, or a step for selective hydrogenation of diolefins, optionally including converting light mercaptans (i.e. RSH type sulphur-containing compounds) to heavier compounds, for example by addition to olefins.

Possible sources of the feed for the process of the invention are the gasoline cut from fluid catalytic cracking (FCC), steam cracking, a light gasoline with a T95 of <90° C., preferably a T95 of <70° C., or effluents from an etherification unit.

The feed for the process of the invention may also be a mixture of the various preceding cuts in any proportions.

The feed used for the oligomerization reaction of step 1) may also be a $C_4$ cut containing more than 50% by weight of linear $C_4$ olefins and less than 5% by weight of isobutene, or a $C_4$ cut containing more than 30% by weight of linear olefins and less than 5% by weight of isobutene, for example from a process for producing MTBE or TAME or a process of the SELECTOPOL (trade name) type, or a $C_3$/$C_4$ cut from a fluid catalytic cracking process, i.e. a cut containing a propane/propylene mixture and a butane/butene mixture.

The catalyst used in oligomerization reactions is an amorphous acid or zeolite type catalyst, with a Si/Al ratio of more than 5, preferably in the range 8 to 80, and more preferably in the range 15 to 70.

Zeolites in the catalyst composition for the process of the invention are at least partially and preferably entirely in the acid form (also termed the protonic form).

The zeolites for the two oligomerization reactors may be used in the protonic form or may have undergone one or more of the treatments described below, in any order:

- partial exchange of protons of the zeolites with metallic cations, for example alkaline-earth metal cations. The cation/T atomic ratio, T representing tetrahedral sites present in the zeolite structure, is generally less than 10%, preferably less than 5% and more preferably less than 1%;
- zeolite dealumination; dealumination methods employing acid attack or steam treatment which are known to the skilled person may all be used; said dealumination allows the Si/Al ratio to be adjusted to the desired value. The overall Si/Al atomic ratio for such dealuminated zeolites is more than 5, preferably more than 10, and more preferably more than 15, still more preferably in the range 20 to 70;
- incorporating at least one element, preferably selected from elements from group VIII of the periodic table. The element may be incorporated into the catalyst using any method known to the skilled person. The quantity of impregnated metal may be over 0.1%, preferably more than 1% and more preferably in the range 1% to 5%;
- selectivation of the acidity of the external surface of the zeolites. The term "selectivation" means neutralizing the acidity of the external surface of said catalyst. The external acidity may be neutralized using any method which is known to the skilled person, in particular by synthesizing another purely silicic zeolite on the external surface of the zeolite used in the process, or any other method described below.

These methods generally employ molecules with a kinetic diameter which is greater than the inlet diameter of the zeolite pores. The methods used may be applied to the catalyst once it is charged into the reactor, i.e. "in situ", or "ex situ".

Molecules may be deposited in the gas phase (chemical vapor deposition, CVD) or by liquid phase deposition (chemical liquid deposition, CLD).

The molecules generally used to render the outer zeolite surface inert are compounds containing atoms which may interact with the acid sites of said zeolite surface. The molecules used are organic or inorganic molecules containing one or more nitrogen, boron, silicon or phosphorus atoms or a mixture of two of those molecules.

Deposition by CLD may be carried out either in an aqueous medium or in an organic solvent. During the aqueous impregnation phase, one or more surfactants may or may not be added to the impregnation solution.

The zeolites may or may not be treated with a strong base before or after placing in the reactor. Preferably, the protons of the zeolites may be exchanged using ammonia or an ammonium salt to form $NH_4^+$ cations.

The catalyst of the present invention also comprises at least one oxide type amorphous or low crystallinity porous mineral matrix, and optionally a binder. Non-limiting examples of matrices which may be cited are alumina, silica, silica-alumina, clays (selected, for example, from natural clays such as kaolin or bentonite), magnesia, titanium oxide, boron oxide, zirconia, aluminium phosphates, titanium phosphates, zirconium phosphates and charcoal. Aluminates may also be selected. In general, it is preferable to use matrices containing alumina, and preferably gamma alumina.

The catalyst obtained may be present in the form of grains with different shapes and dimensions. Said grains generally have the form of cylindrical or poly-lobed extrudates such as bilobes, trilobes, polylobes with a straight or twisted form, but may also be manufactured and used in the form of crushed powders, tablets, rings, beads or wheels.

Shaping may be carried out before or after any of the catalyst modification steps described above.

Preferably, the catalyst used for the oligomerization of step 1) is a zeolitic catalyst selected from the group comprising zeolites having 8 MR and/or 10 MR channels, preferably zeolites having 8 MR channels which are dealuminated, or zeolites having one- and two-dimensional 10 MR channels, and more preferably zeolites having one-dimensional 10 MR channels. The catalyst used for step 1) oligomerization may also be used mixed in any proportions with the preceding zeolites.

Examples of preferred zeolites in the context of the present invention are zeolites with the following structures: MEL, MFI, ITH, NES, EUO, ERI, FER, CHA, MFS, MWW, MTT, TON. ZSM-11 is the preferred zeolite with structure type MEL. ZSM-5 is the preferred zeolite with structure type MFI. ITQ-13 is the preferred zeolite with structure type ITH. NU-87 is the preferred zeolite with structure type NES. EU-1 is the preferred zeolite with structure type EUO. Erionite is the preferred zeolite with structure type ERI. Ferrierite and ZSM-35 are the preferred zeolites with structure type FER. Chabazite is the preferred zeolite with structure type CHA. ZSM-57 is the preferred zeolite with structure type MFS. MCM-22 is the preferred zeolite with structure type MWW. ZSM-23 is the preferred zeolite with structure type MTT. ZSM-22 is the preferred zeolite with structure type TON. These zeolites may be used alone or as a mixture in any proportions.

The oligomerization reaction of the first step is carried out at a temperature of 40° C. to 600° C., preferably 60° C. to 400° C., and more preferably 190° C. to 280° C. at a pressure of 0.1 to 10 MPa, preferably 0.3 to 7 MPa, and at an hourly space velocity of 0.01 to 100 $h^{-1}$, preferably 0.4 to 30 $h^{-1}$, and more preferably 0.8 to 10 $h^{-1}$.

The selected conditions can encourage the dimerization reaction from within the gamut of oligomerization reactions.

The reactor may be of the fixed bed, fluidized bed or moving bed type. It may if necessary be constituted, given the exothermic nature of the oligomerization reaction, by one or more beds with intermediate chilling.

The effluent from the first oligomerization step feeds a separation step. This step can produce:

a light $C_4$ and/or $C_5$ cut, denoted $C_4$-$C_5$;

an intermediate cut supplying the second reaction step; and a heavy gas oil type cut the distillation interval of which, typically after hydrogenation, is in the range 160° C. to 370° C., preferably in the range 200° C. to 365° C.

The intermediate cut has a T95 in the range 180° C. to 240° C., preferably in the range 200° C. to 220° C., T95 being the temperature at which 95% by weight of said cut has evaporated, as determined using the standardized ASTM D2887 method.

In particular, This cut contains dimers obtained at the end of the first oligomerization step, i.e. in particular $C_6$-$C_{24}$ hydrocarbons, preferably $C_6$-$C_{14}$, and more preferably $C_6$-$C_{10}$.

The heavy cut constitutes the complement, i.e. the whole of the products from step 1) which constitute neither the light cut nor the intermediate cut. In particular, it contains hydrocarbons containing more than 8 carbon atoms, preferably more than 10 carbon atoms.

This separation step may be constituted by a concatenation of two distillation columns. In such a concatenation, the first column separates a gas oil cut from a light cut. Said light cut supplies a second column for separation into the light cut of the invention and the intermediate cut of the invention.

In a further concatenation, the first column separates the light cut of the invention from a heavy cut. The heavy cut supplies a second column for separation into the intermediate cut of the invention and a gas oil cut.

In a further arrangement, this step is constituted by a column with internal walls such as that described, for example, by Schultz et al in CEP Magazine, May 2002, pages 64-71 or in U.S. Pat. Nos. 4,230,533 or 5,339,648 or 5,755,933. It is also possible to incorporate one or the other of the oligomerization reaction sections (steps 1) or 3)) into a fractionation column (steps 2) or 4)), as disclosed in patent applications concerning reactive columns, US 2004/0204614 A1 or US 2004/0210092 A. According to that arrangement, oligomerization and separation respectively corresponding to steps 1) and 3) and to steps 2) and 4) are carried out in a single reactor which also acts as a fractionation column.

The feed is supplied to one side of the column. The intermediate cut is removed as a side stream, generally from the other side of the column. The light cut and the gas oil cut are respectively withdrawn from the head and bottom of the column.

The oligomerization feed for step 3) is constituted by the intermediate cut from the separation step and a makeup of olefinic $C_4$ and/or $C_5$ hydrocarbons deriving from all or part of the light fraction from said separation.

In an advantageous implementation, the olefinic $C_4$ and/or $C_5$ hydrocarbon cut derives from the light cut from separation step 2).

The catalysts used in the first oligomerization step are preferably zeolitic catalysts selected from the group comprising zeolites having 10 MR and/or 12 MR channels, preferably three-dimensional, zeolites having 12 MR channels which are one-dimensional and dealuminated, and mixtures thereof.

Preferred 12 MR zeolites for use in this invention are zeolites with the following structures: MOR, FAU, BEA, BOG, LTL, OFF. Mordenite is the preferred zeolite with structure type MOR. Y zeolite is the preferred zeolite with structure type FAU. Beta zeolite is the preferred zeolite with structure type BEA. Boggsite is the preferred zeolite with structure type BOG. L zeolite is the preferred zeolite with structure type LTL. Offretite is the preferred zeolite with structure type OFF. These zeolites may be used alone or as a mixture.

The temperature of the reactor for carrying out step 3) of the invention is in the range 40° C. to 600° C., preferably 60° C. to 400° C. The pressure is in the range 0.1 to 10 MPa, preferably in the range 0.3 to 7 MPa. The hourly space velocity is in the range 0.01 to 100 $h^{-1}$, preferably in the range 0.4 to 30 $h^{-1}$.

The reactor may be a fixed bed, fluidized bed or moving bed reactor. It may be constituted by one or more beds with intermediate chilling.

In accordance with one implementation of the invention, the process is carried out in accordance with the flowchart of FIG. 1.

The chart for process 1 comprises three units, a first oligomerization reactor (2), a distillation column (3), optionally with internal walls and a second oligomerization reactor (4).

The feed is introduced via a line (5) to the head of the oligomerization reactor (2). The essentially dimerized reaction effluent is routed via a line (6) to the distillation column (3).

In the distillation column (3), the mixture is separated into three cuts, a light cut which is evacuated overhead via a line (7), an intermediate cut evacuated from the middle of the column via a line (8) which divides into a line (8*a*) which supplies a recovery system or a gasoline treatment system (not shown in FIG. 1) and a line (8*b*) which supplies the head of a second oligomerization reactor (4).

A heavy cut is withdrawn from the bottom of column (3) via a line (9) which supplies a gas oil cut hydrogenation reactor (not shown in FIG. 1).

The light cut (7) is routed either towards the head of the first oligomerization reactor (2) via a line 10*a* or towards the head of the second oligomerization reactor (4) via a line 10*b*. A purge (11) is installed on line (10) to evacuate volatile products.

A regulating valve (not shown in FIG. 1) is disposed between lines (8*a*) and (8*b*) so that the second oligomerization reactor (4) is supplied continuously with a predetermined and regulated amount of intermediate cut and light cut.

The gas oil cut is withdrawn from the second oligomerization reactor (4), via a line (12) which supplies a gas oil cut hydrogenation reactor (not shown in FIG. 1).

In a preferred implementation of the invention shown in FIG. 2, the unit comprises, as for FIG. 1, two oligomerization reactors (13) and (14) and one distillation column with internal walls (15), but a portion of the gas oil cut (21) from the oligomerization reactor (4) is mixed with the gas oil cut from the oligomerization reactor (13) and introduced into the separation column (15).

The feed is introduced via a line (16) to the head of the oligomerization reactor (13); the oligomerization effluent (17) is withdrawn from the bottom of the reactor (13) via a line (17) which supplies the distillation column (15). In the distillation column, a light fraction evacuated from the column head (18) is separated from an intermediate fraction (19) which supplies the oligomerization reactor (14) mixed with a portion (18*b*) of the light cut from column (15), and a gas oil fraction (20) which is withdrawn from the bottom of the column (15).

A portion of the light fraction (18) supplies the first oligomerization reactor (13) via (18*a*), and the second oligomerization reactor (14) via (18*b*). The second oligomerization reactor (14) is also supplied with intermediate fraction via (19). The light fraction/intermediate fraction mixture, prepared in predetermined proportions, is oligomerized in the reactor (14). The oligomerization effluent (21) is withdrawn from the bottom of the reactor (14), via line (21), a portion (22) of which is directed to a gas oil cut hydrogenation reactor (not shown in FIG. 1).

A further portion of the oligomerization effluent (21) is sent via a line (23) to the line (17) supplying the distillation column (15).

Clearly, regulating valves are installed:

- at the connection of lines (18), (18*a*), (18*b*) to regulate the stream bringing the light cut to the first oligomerization reactor (13) and to the second oligomerization reactor;
- at the connection of lines (21), (22) and (23) to regulate withdrawal from the second oligomerization reactor (14) and supply to the column (15);
- at the connection of lines (19) and (18*b*) to regulate the light cut/intermediate cut ratio supplying the second oligomerization reactor (14).

The invention will now be illustrated with the aid of the following non-limiting examples.

EXAMPLES

Example 1

Prior Art

A raffinate type II cut supplied a first oligomerization step over a ZSM-5 type acidic zeolitic catalyst. The reaction conditions were as follows:

Pressure: 6 MPa

Temperature: 200° C.-250° C.;

Hourly space velocity: HSV: 1 $h^{-1}$.

The effluent from the first oligomerization step supplied a first separation step from which all of the $C_4$s were withdrawn overhead. The bottom of the column supplied a second separation step in which an intermediate cut with a boiling point of less than 200° C. (cut denoted "gasoline" or 200° C.−), a heavy cut with a boiling point of more than 200° C. (cut denoted "gas oil" cut or 200° C.+) were separated.

The gasoline cut supplied a second oligomerization step over a ZSM-5 type zeolitic acid catalyst. The oligomerization conditions were as follows:

Pressure: 6 MPa

Temperature: 200° C.-250° C.;

Hourly space velocity: HSV: 1 $h^{-1}$.

The effluent from the second oligomerization step was separated into a gasoline cut (200° C.) and a gas oil cut (200° C.+). The two gas oil cuts from the separation column and the second oligomerization step were combined.

The overall yield for the gas oil cut was 23.3%.

The gas oil fraction was hydrogenated over a 10% Pd catalyst on charcoal at 120° C. under 5 MPa of hydrogen.

The cetane index for this gas oil fraction was 43.

The bromine number was 0.3 gBr/100 g.

The smoke point was less than −15° C.

Example 2

In Accordance with the Invention; FIG. 2

A raffinate type II cut supplied a first oligomerization step (13) over a FER type acidic zeolitic catalyst. The conditions for the first oligomerization step (13) were as follows:

Pressure: 6 MPa

Temperature: 200° C.-250° C.;

Hourly space velocity: HSV: 1 $h^{-1}$.

The effluent from the first oligomerization step (13) was mixed with the effluent from the second oligomerization step (14).

The mixture supplied a separation step (15) from which all of the $C_4$s were withdrawn overhead (18). A gasoline cut was withdrawn as a side stream (19). The gas oil cut (200° C.+) was withdrawn from the column bottom (15) via a line (20).

20% by weight of $C_4$ cut (18*b*) from the head of the separation column (15) was added to the light gasoline cut (19). This mixture supplied a second oligomerization step (14) over a ZSM-5 zeolitic acidic catalyst.

The conditions for the second oligomerization (14) were as follows:

Pressure: 6 MPa

Temperature: 200° C.-250° C.;

HSV: 1 $h^{-1}$.

The effluent from the second oligomerization step (14) was sent to the separation step (15).

The overall yield for the gas oil cut (20) was 31.8%. The gas oil fraction was hydrogenated over a 10% Pd catalyst on charcoal at 120° C. under 5 MPa of hydrogen.

The cetane index for this gas oil fraction was 52.

The bromine number was 0.3 gBr/100 g.

The smoke point was less than −15° C.

Example 3

A raffinate type II cut supplied a first oligomerization step (13) over a FER type acidic zeolitic catalyst. The conditions for the first oligomerization 13 were as follows:

Pressure: 6 MPa

Temperature: 200° C.-250° C.;

Hourly space velocity: HSV: 1 $h^{-1}$.

The effluent from the first oligomerization step (13) was mixed with the effluent from the second oligomerization step (14).

The mixture supplied a separation step (15) from which all of the $C_4$s were withdrawn overhead (18).

A gasoline cut was withdrawn as a side stream (19).

The gas oil cut (200° C.+) was withdrawn from the column bottom via a line (20).

20% by weight of $C_4$ cut (18*b*) from the head of the separation column (15) was added to the gasoline cut (19). This mixture supplied a second oligomerization step (14) over a ZSM-5 zeolitic type acidic catalyst.

The reaction was carried out under the following conditions:

Pressure: 6 MPa

Temperature: 200° C.-250° C.;

HSV: 1 $h^{-1}$.

The effluent from the second oligomerization step (14) was sent to the separation step (15).

The overall yield for the gas oil cut (20) was 30.9%. The gas oil fraction was hydrogenated over a 10% Pd catalyst on charcoal at 120° C. under 5 MPa of hydrogen.

The cetane index for this gas oil fraction was 53.

The bromine number was 0.3 gBr/100 g.

The smoke point was less than −15° C.

Example 4

A raffinate type II cut supplied a first oligomerization step (13) over a FER type acidic zeolitic catalyst. The reaction conditions were as follows:

Pressure: 6 MPa

Temperature: 200° C.-250° C.;

Hourly space velocity: HSV: 1 $h^{-1}$.

The effluent from the first oligomerization step (13) was mixed with the effluent from the second oligomerization step (14).

The mixture supplied a separation step (15) from which all of the $C_4$s were withdrawn overhead via line (18).

A gasoline cut (200° C.−) was withdrawn as a side stream via line (19). The gas oil cut (200° C.+) was withdrawn from the column bottom via a line (20).

20% by weight of $C_4$ cut from the head of the separation column (15) was added to the gasoline cut (19) via line (18).

This mixture supplied a second oligomerization step (14) over a zeolitic ZSM-5 acidic catalyst.

The reaction conditions were as follows:

Pressure: 6 MPa

Temperature: 200° C.-250° C.;

HSV: 1 $h^{-1}$.

The effluent from the second oligomerization step (14) was sent to the separation step (15).

The overall yield for the gas oil cut (20) was 33.5%. The gas oil fraction was hydrogenated over a 10% Pd catalyst on charcoal at 120° C. under 5 MPa of hydrogen.

The cetane index for this gas oil fraction was 52.

The bromine number was 0.3 gBr/100 g.

The smoke point was less than −15° C.

Example 5

A raffinate type II cut supplied a first oligomerization step (13) over a FER type acidic zeolitic catalyst. The reaction was carried out under the following conditions:

Pressure: 6 MPa

Temperature: 200° C.-250° C.;

Hourly space velocity: HSV: 1 $h^{-1}$.

The effluent from the first oligomerization step (13) was mixed with the effluent from the second oligomerization step (14).

The mixture supplied a separation step (15) from which all of the $C_4$s were withdrawn overhead (18).

70% by weight of $C_4$ cut was recycled to the first oligomerization step (13) via line 18*a*. A gasoline cut (200° C.−) was withdrawn via line (19) as a side stream. The gas oil cut (200° C.+) was withdrawn from the column bottom (15) via line (20).

30% by weight of $C_4$ cut from the head of the separation column (15) was added to the gasoline cut (19) via line 18*b*. This mixture supplied a second oligomerization step (14) over a ZSM-5 zeolitic acidic catalyst. The conditions for the oligomerization (14) were as follows:

Pressure: 6 MPa

Temperature: 200° C.-250° C.;

HSV: 1 $h^{-1}$.

The effluent from the second oligomerization step (14) was sent to the separation step (15).

The overall yield for the gas oil cut (20) was 72.9%. The gas oil fraction (20) was hydrogenated over a 10% Pd catalyst on charcoal at 120° C. under 5 MPa of hydrogen.

The cetane index for this gas oil fraction was 49.

The bromine number was 0.3 gBr/100 g.

The smoke point was less than −15° C.

Example 6

A raffinate type II cut supplied a first oligomerization step (13) over a FER type acidic zeolitic catalyst. The conditions for the first oligomerization (13) were as follows:

Pressure: 6 MPa

Temperature: 200° C.-250° C.;

Hourly space velocity: HSV: 1 $h^{-1}$.

The effluent from the first oligomerization step (13) was mixed with the effluent from the second oligomerization step (14). The mixture supplied a separation step (15) from which all of the $C_4$s were withdrawn overhead via line (18). The $C_4$s were recycled to the first oligomerization step (13). A gasoline cut (200° C.–) was withdrawn as a side stream (19).

The gas oil cut (200° C.+) was withdrawn from the column bottom via a line (20).

30% by weight of $C_4$ cut from the head of the separation column (15) was added to the gasoline cut (19) via line (18).

This mixture supplied a second oligomerization step (14) over a ZSM-5 zeolitic acidic catalyst. The oligomerization conditions were as follows:

Pressure: 6 MPa

Temperature: 200° C.-250° C.;

HSV: 1 $h^{-1}$.

The effluent from the second oligomerization step (14) was sent to the separation step (15).

The overall yield for the gas oil cut (20) was 75.5%.

The gas oil fraction was hydrogenated over a 10% Pd catalyst on charcoal at 120° C. under 5 MPa of hydrogen.

The cetane index for this gas oil fraction was 52.

The bromine number was 0.3 gBr/100 g.

The smoke point was less than −15° C.

The summarizing table below shows that Examples 2 to 6 of the invention were accompanied by a large increase in the cetane index and an increase in the gas oil cut yields obtained compared with prior art Example 1.

Table summarizing performances in the 6 examples

| Example | % $C_4$ added | GO yield, % | Cetane index |
|---|---|---|---|
| 1 (prior art) | 0 | 23 | 43 |
| 2 (invention) | 20 | 31.8 | 52 |
| 3 (invention) | 20 | 30.9 | 53 |
| 4 (invention) | 20 | 33.5 | 52 |
| 5 (invention0 | 30 | 72.9 | 49 |
| 6 (invention) | 30 | 75.5 | 52 |

The entire disclosures of all applications, patents and publications, cited herein and of corresponding French application No. 05/06.589, filed Jun. 28, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for preparing a gas oil cut, comprising the following steps in succession:

1) in a first oligomerization reactor, catalytically oligomerizing an olefinic $C_2$-$C_{12}$ hydrocarbon cut, said oligomerizing being mainly dimerization;

2) in a separation column separating a mixture of products obtained from step 1) into three cuts: a light olefinic cut containing unreacted olefinic $C_4$ and/or $C_5$ hydrocarbons with a T95 of less than 100° C., an intermediate cut of dimers having a T95 in the range 180° C. to 240° C., and a first heavy gas oil cut having a T95 of more than 220° C. and higher than the T95 of the intermediate cut;

3) in a second oligomerization reactor, catalytically oligomerizing the intermediate cut obtained from the separation column with a portion of the light olefinic $C_4$-$C_5$ cut from said separation step in proportions such that the ratio between the intermediate cut and the light olefinic $C_4$-$C_5$ cut is in the range of 60/40 to 80/20 by weight.

2. A process according to claim 1, wherein each of the oligomerization reactions of steps 1) and 3) is carried out in the presence of an amorphous acidic catalyst or a zeolite type catalyst with a Si/Al ratio of more than 5.

3. A process according to claim 1, wherein the oligomerization catalyst of step 1) is a zeolitic catalyst selected among zeolites having 8 MR and/or 10 MR channels, zeolites having one- and two-dimensional 10 MR channels, and zeolites having one-dimensional 10 MR channels, and mixtures thereof.

4. A process according to claim 1, wherein the oligomerization catalyst of step 3) is a zeolitic catalyst selected among zeolites having 10 MR and/or 12 MR channels, preferably three-dimensional, zeolites having 12 MR channels which are one-dimensional and dealuminated, and mixtures thereof.

5. A process according to claim 1, wherein each of oligomerization steps 1) and 3) is carried out at a temperature of 40° C. to 600° C., at a pressure of 0.1 to 10 MPa, and at an hourly space velocity of 0.01 to 100 $h^{-1}$.

6. A process according to claim 1, further comprising a step 4) for separating the product obtained at the end of the oligomerization step 3) from the second oligomerization reactor into a light olefinic cut, an intermediate cut and a second heavy gas oil cut, said light olefinic, intermediate and heavy cuts being as defined in claim 1.

7. A process according to claim 6, further comprising recycling at least part of the light olefinic cut obtained in step 4) to the oligomerization step 3) in the second oligomerization reactor.

8. A process according to claim 1, further comprising mixing a part of the second gas oil cut (21) from the second oligomerization reactor (14) with the first gas oil cut from the first oligomerization reactor (13) and introducing the resultant mixture into the separation column (15).

9. A process according to claim 1, wherein the separation of step 2) and optionally of step 4) is carried out by distillation in a column with internal walls.

10. A process according to claim 1, wherein the light olefinic cut has a T95 of less than 50° C.

11. A process according to claim 1, wherein the intermediate cut has a T95 in the range of 200° C. to 220° C.

12. A process according to claim 1, wherein the first heavy gas oil product has a T95 of more than 240° C.

13. A process according to claim 10, wherein the intermediate cut has a T95 in the range of 200° C. to 220° C.

14. A process according to claim 10, wherein the first heavy gas oil product has a T95 of more than 240° C.

15. A process according to claim 13, wherein the first heavy gas oil product has a T95 of more than 240° C.

16. A process according to claim 1, further comprising subjecting the first heavy gas oil cut directly to hydrogenation.

17. A process according to claim 16, wherein the resultant hydrogenated gas oil cut has the following properties:

a distillation interval of 160° C. to 370° C.;

a cetane index of at least 45;

a viscosity, according to ISO 3104 at 40° Cm if 2,2 ti 4,5 cSt;

a smoke point of less than −10° C.;

density: 0.8 to 0.85 g/$cm^3$;

a bromine index of less than 13 gBr/100 g.

18. A process according to claim 1, wherein the intermediate cut consists essentially of $C_6$-$C_{24}$ hydrocarbons.

19. A process according to claim 1, wherein the intermediate cut consists essentially of $C_6$-$C_{14}$ hydrocarbons.

20. A process according to claim 6, wherein the intermediate cut consists essentially of $C_6$-$C_{10}$ hydrocarbons.

21. A process according to claim 20, wherein the second heavy gas oil cut consists essentially of linear hydrocarbons having at least 12 carbon atoms per molecule.

22. A process according to claim 6, wherein said second heavy gas oil cut consists essentially of $C_{12}$, $C_{16}$, $C_{20}$, $C_{24}$, $C_{28}$ and $C_{32}$ hydrocarbons.

23. A process according to claim 1, wherein the oligomerization catalyst of step (1) consists essentially of an FER type acidic zeolitic catalyst and the catalyst of step (3) is a ZSM-5 zeolitic acidic catalyst.

* * * * *

UNITED STATES PATENT AND TRADEMARK OFFICE

CERTIFICATE OF CORRECTION

PATENT NO. : 7,476,773 B2
APPLICATION NO. : 11/476203
DATED : January 13, 2009
INVENTOR(S) : Sylvain Louret It is certified that error appears in the above-identified patent and that said Letters Patent is hereby corrected as shown below:

On the Front Page, item [75] Inventors: line 1, reads “Lyons” should read -- Lyon --
On the Front Page, item [75] Inventors: line 3, reads “Lyons” should read -- Lyon --
Column 12, line 57, reads “Cm if 2,2 ti 4,5” should read -- C, of 2.2 to 4.5 --

Signed and Sealed this

Twenty-sixth Day of May, 2009

JOHN DOLL
*Acting Director of the United States Patent and Trademark Office*